United States Patent [19]
Batra

[11] Patent Number: 4,479,805
[45] Date of Patent: Oct. 30, 1984

[54] TREATING-HIGH ASPHALTENE FUEL OILS

[75] Inventor: Sushil K. Batra, Shrewsberry, Mass.

[73] Assignee: Columbia Chase Corporation, Braintree, Mass.

[21] Appl. No.: 531,257

[22] Filed: Sep. 12, 1983

[51] Int. Cl.³ ..... C10L 1/32
[52] U.S. Cl. ..... 44/51; 44/61; 252/311.5
[58] Field of Search ..... 44/51, 61; 252/311.5

[56] References Cited

U.S. PATENT DOCUMENTS

| | | | |
|---|---|---|---|
| 1,618,669 | 2/1927 | Morrell | 208/177 |
| 1,625,237 | 4/1927 | Bowman | 44/51 |
| 1,638,314 | 8/1927 | Barth et al. | 44/51 |
| 1,698,878 | 1/1929 | Cone | 252/311.5 |
| 1,770,181 | 7/1930 | Morrell | 44/51 |

FOREIGN PATENT DOCUMENTS

| | | | |
|---|---|---|---|
| 0569731 | 6/1945 | United Kingdom | 252/311.5 |
| 0585319 | 2/1947 | United Kingdom | 252/311.5 |

*Primary Examiner*—William R. Dixon, Jr.
*Assistant Examiner*—Margaret B. Medley
*Attorney, Agent, or Firm*—Andrew F. Kehoe

[57] ABSTRACT

A process for the treatment of asphaltene-bearing fuel oils to reduce the amount of acid-smut in stack gas often emitted during the combustion of such fuels. The fuel is passed through a liquid shearing apparatus, with the addition of controlled amounts of water, to substantially reduce the size of the asphaltene particles. Generally, the treated oil will have a majority of asphaltene particles with a diameter of less than 2 microns, and substantially all asphaltene particles with a diameter of 7 microns or less. The processed fuel will also have uniformly dispersed asphaltene particles.

16 Claims, 3 Drawing Figures

TREATING-HIGH ASPHALTENE FUEL OILS

BACKGROUND OF THE INVENTION

This invention relates to processes used in the conditioning of fuel oils to provide for a cleaner burning and more thermally efficient fuel.

Fuel oils contain suspended particles of matter called asphaltenes which are high molecular weight residues of the petroleum distillation process. The presence of asphaltenes in a fuel oil creates problems in both the storage and burning of the fuel. The high molecular weight of this residue causes it to settle at the bottom of storage tanks, forming a solid mass thus necessitating frequent and costly cleaning. Moreover, these relatively insoluble particles tend to clog oil strainers and filters, and will eventually foul the oil heater and burner tip resulting in frequent repairs and corresponding high maintenance costs.

When fuel oils containing a substantial asphaltene content (e.g. 2–12 weight%) are burned a variety of problems result. As the asphaltene is more difficult to burn a significant amount of this material passes through the furnace as unburned particulate matter thus causing a substantial decrease in the thermal efficiently of the fuel.

The unburned particulate matter also creates serious environmental problems. The unburned combustibles which pass through the furnace are frequently low density, electrically conductive cenospheric materials having a high carbon content. Such physical properties render the non-combusted matter incapable of being efficiently collected by electrostatic precipitators thereby causing an increase in particulate emissions. To compound the environmental problem, the unburned carbon tends to absorb sulfuric acid, a by-product of the combustion of high sulfur oils, in the combustion system and stack, resulting in acid smut fallout.

Various treatments of very heavy hydrocarbon fuels to prepare them for further processing are disclosed in U.S. Pat. Nos. 1,390,231, 1,618,669 and 1,770,181. Generally, these disclosures teach methods for homogenizing heavy fuel mixtures containing liquid hydrocarbon and coarse pitch-forming, coke-like particles of solid impurities. U.S. Pat. No. 1,618,669 describes a method whereby the fuel is separated into its solid and liquid components. Likewise, U.S. Pat. Nos. 1,390,231 and 1,770,181 teach homogenizing the oil using mechanical work to disperse and decrease the size of coarse ashes and coke-like particles.

None of this early work is directed to mitigating the effects of small, but bothersome concentrations of asphaltenes in heavy fuel oils (e.g. fuel oil numbers 4–6) resulting in the problems associated with acid smut fallout.

SUMMARY OF THE INVENTION

Therefore, it is a principal object of this invention to provide an improved procedure for preparing very heavy fuel oils for combustion and minimizing stack pollution problems.

Another object of the invention is to reduce the amount of acid smut particulate matter which is emitted from plants burning high asphaltene fuels.

A further object of the invention is to improve the thermal efficiency of fuels bearing a substantial amount of asphaltenes.

Still another object of the invention is to decrease the maintenance costs associated with the storage and burning of high asphaltene fuel oils by eliminating the problem of clogged fuel filters and strainers caused by asphaltenes.

Other objects of the invention will be obvious to those skilled in the art on reading this disclosure.

The above objects have been substantially achieved by the discovery of a process for applying a combination of mechanical work and a controlled amount of water to the fuel oil in such a manner as to disperse the particles in the fuel and substantially decrease the size of these asphaltene particles, thus making them more readily combustible. Within this general framework, important parameters are discussed as follows.

The process invented involves the passing of asphaltene-laden heavy fuel oils through restricted diameter orifices in a closed pressurized system under carefully controlled conditions. Depending upon the concentration of asphaltene present in the oil, a controlled amount of water may or may not be added to the fuel being treated. However, it is generally desirable to add some water, and one aspect of the invention is the control of water content so that it aids asphaltene dispersion or, at least, does not interfere with asphaltene dispersion. Likewise, the operating pressure of the system may also be varied depending upon the concentration of asphaltene in a particular oil.

To obtain the best results, the orifices are arranged in a parallel configuration within the system, causing the oil to be forced through the restricted diameter by a positive displacement pump, at a flow rate, measured by a calibrated meter. Preferably, the orifices are set in an array containing approximately 30 to 70 such orifices, each having a diameter of about 9/32 of an inch. The equipment utilized was the complete combustion conditioner available from Columbia Chase Corporation of Braintree, Mass.

The pressure necessary for effective fuel conditioning may be varied by adjusting the effluent valve of the complete combustion conditioner. The shear forces which result as the pressure is increased contribute substantially to the conditioning of fuel oils.

The effect of this invention is to condition heavy fuel oils (e.g. fuel oil Nos. 4–6) having low to high concentrations of asphaltene (e.g. 2–12 weight%). By processing the fuel in this manner it is possible to decrease the average size of particles present in the oil, thus achieving a corresponding increase in particle density as well as a more uniform dispersion of the particles. The beneficial effects which result from this invention are not merely temporary. Fuel oils subjected to this treatment will retain their reduced asphaltene particle sizes and uniform dispersion over a commercially useful time, without further processing, before they are burned. As noted above, such a treatment will yield a fuel possessing cleaner burning characteristics and more favorable combustion properties.

This process is best described by separately discussing its application to low-medium asphaltene fuels and high asphaltene fuels.

LOW-MEDIUM ASPHALTENE FUELS (e.g. oils of about 2–5 weight% Asphaltene)

Untreated low or medium asphaltene fuel oils (for example, No. 6 fuel oil having 4.86 weight% asphaltene) can be expected to possess a particle density of about 566,000 particles per gram of oil and an average particle size of approximately 2 microns, as measured by observing 20 randomly selected locations using transmission electron microscopy and optical microscopy. Approximately 1% of the observable particles in the untreated oil samples can be expected to be greater than 10 microns in diameter.

Following treatment of the oil using the invented process, the visible particle size of most particles will decrease to approximately 2.5 microns while the particle density will show a corresponding increase. A majority of the particles present in the 25 treated low-medium asphaltene oil (e.g. 2–5 weight % asphaltene) will fall within the range of 1–2 microns in diameter. Use of this process on such a fuel oil at optimal conditions also virtually eliminates the presence of any particle greater than 7 microns in diameter.

The best results occur while processing the low-to-medium asphaltene oils at 200 pounds per square inch in the presence of 10 weight% water. However, pressure and water content may be varied to achieve various qualities of the treated fuel oil. For example, as pressure is increased, in the absence of water particle size will increase. Although the inventor does not wish to be bound by the theory, it is believed that this result is apparently due to the tendency of asphaltene to form strands upon being forced through the orifices. These strands tend to re-agglomerate and manifest themselves as larger particles. The addition of increasing amounts of water to the system will initially increase the size of these agglomerates. However, as the water content approaches 10 weight%, the asphaltene agglomerations will be broken up into much fine particles which will become uniformly dispersed throughout the oil-water mixture. If the water content is allowed to go much beyond 10 weight% larger particles begin to reappear.

Treated fuel oils of fairly good quality will also result if the oil is processed at 100 psig with 5 weight% water. Under such conditions particle density is fairly high, but the average particle size will be somewhat larger than that for fuel oil processed under the optimal conditions of 200 psig with 10 weight% water.

HIGH ASPHALTENE OILS (e.g. oils of about 6 to about 12 weight % asphaltene)

Prior to treatment by this process high asphaltene fuel oils (for example, No. 6 fuel oil having 8.39 weight% asphaltene) generally possess a greater number of large asphaltene agglomerations than the lower asphaltene oils. For such oils the average particle size is expected to be about 2.1 microns in diameter while particle density is roughly 214,000 particles per gram of oil. Approximately 20% of the particles present in a typical sample of high asphaltene oils are expected to be of fairly large diameter (i.e. 4–8 microns).

A typical treatment of an oil of this type at optimal conditions can be expected to yield particles having an average diameter of approximately 1.6 microns and a particle density of about 748,000 particles per gram of oil. Generally, following conditioning of the oil, there should be no substantial proportion of particles greater than 5 microns in diameter. Approximately 75% of the particles should range in diameter from 1–2 microns. Good shear-processing conditions for fuel oils having a high asphaltene content are 200 psig and 5 wt% water. It is under such conditions that the smallest particle size may be attained.

When the water content is increased beyond 5 wt%, the average asphaltene particle size will steadily increase. Also, within this water content range, relatively large water droplets may form. Typically, too much water will cause combustion problems. However, in some cases (e.g. about 10 wt% water) water droplets may be desirable because of the energy released as water droplets burst during combustion and the other beneficial effects of water in oil emulsion fuel systems.

ILLUSTRATIVE EXAMPLE OF THE INVENTION

In this application there is shown and described a preferred embodiment of the invention as well as various alternatives and modifications thereof, but it is to be understood that these are not intended to be exhaustive and that other changes and modifications can be made within the scope of this invention. These suggestions herein are selected and included for the purposes of illustration in order that others skilled in the art will more fully understand the invention and embody it in a variety of forms, each as may be best suited to the condition of a particular case.

Examples of the process of the invention were carried out using two samples of No. 6 fuel oil, each containing different concentrations of asphaltene. Sample A is a low to medium asphaltene oil having a 4.86 wt% asphaltene content. Sample B is a high asphaltene oil containing 8.39 wt% asphaltene. In each case the oil was processed while varying both the amount of water (from 0% to 20 wt%) and the operating pressure on the oil being passed through the complete combustion conditioner (100 psig and 200 psig).

Figure 1:
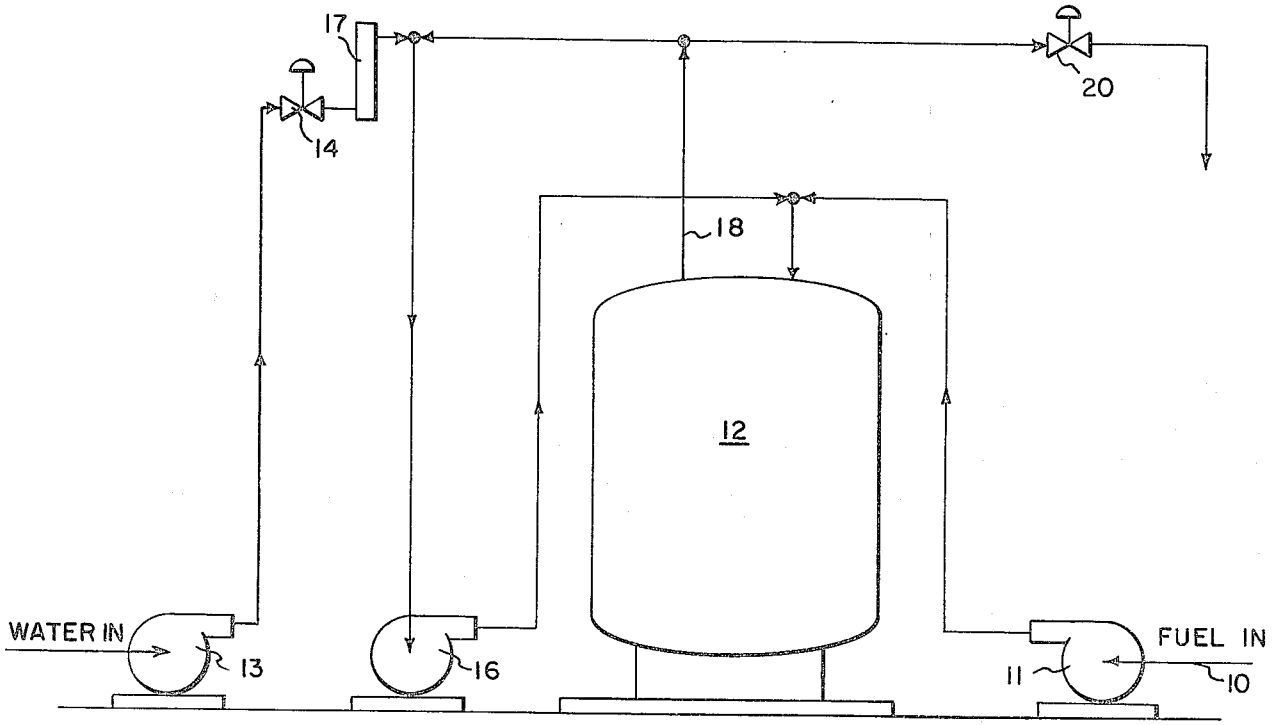
FIG. 1 is a schematic diagram of a fuel oil conditioner used in the present invention.

Referring to FIG. 1, it is seen that fuel oil 10 is passed through a positive displacement pump 11 and into a complete combustion conditioner 12, of the type available from the Columbia Chase Corporation. Simultaneously, a positive displacement water pump 13 transfers water through a water control valve 14 and a second pump 16 moves the water into the complete combustion conditioner 12. The flow of water may be monitored by a water flow indicator 17. Once in the conditioner water is dispersed within the fuel and the asphaltene particle size is decreased. It is possible to remove the fuel-water mixture from the conditioner via the effluent pipe 18 and water pump 16 for additional processing. However, a single treatment in the conditioner is generally adequate to process the fuel to its optimum characteristics. In such case the conditioned fuel will exit the system through the effluent pipe and the effluent back pressure valve 20.

Figure 2:
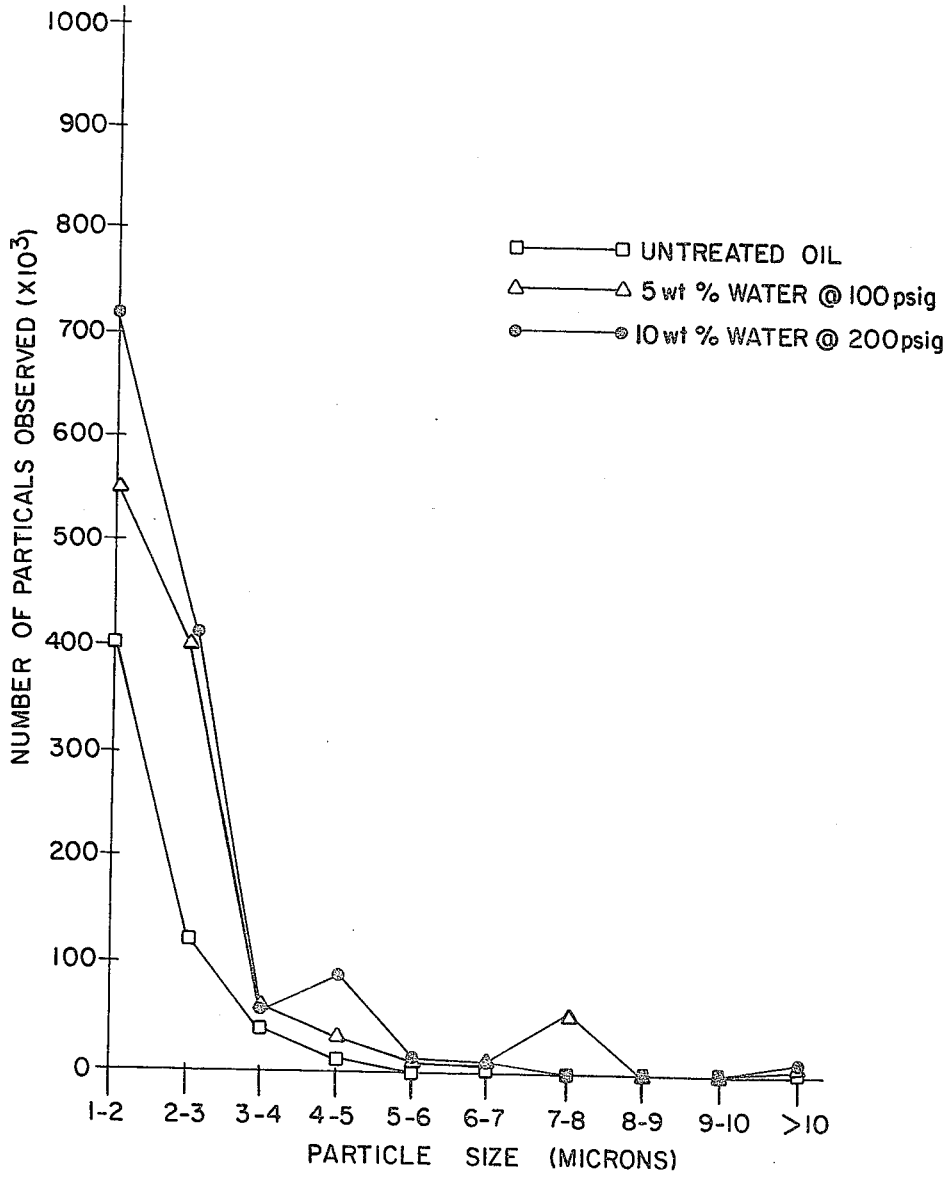
FIG. 2 is a graph showing the number of particles observed in various size ranges, before and after treatment of a low-medium asphaltene oil (e.g. No. 6 fuel oil having 4.86 weight% asphaltene) using the most desirable processing variables.
Figure 3:
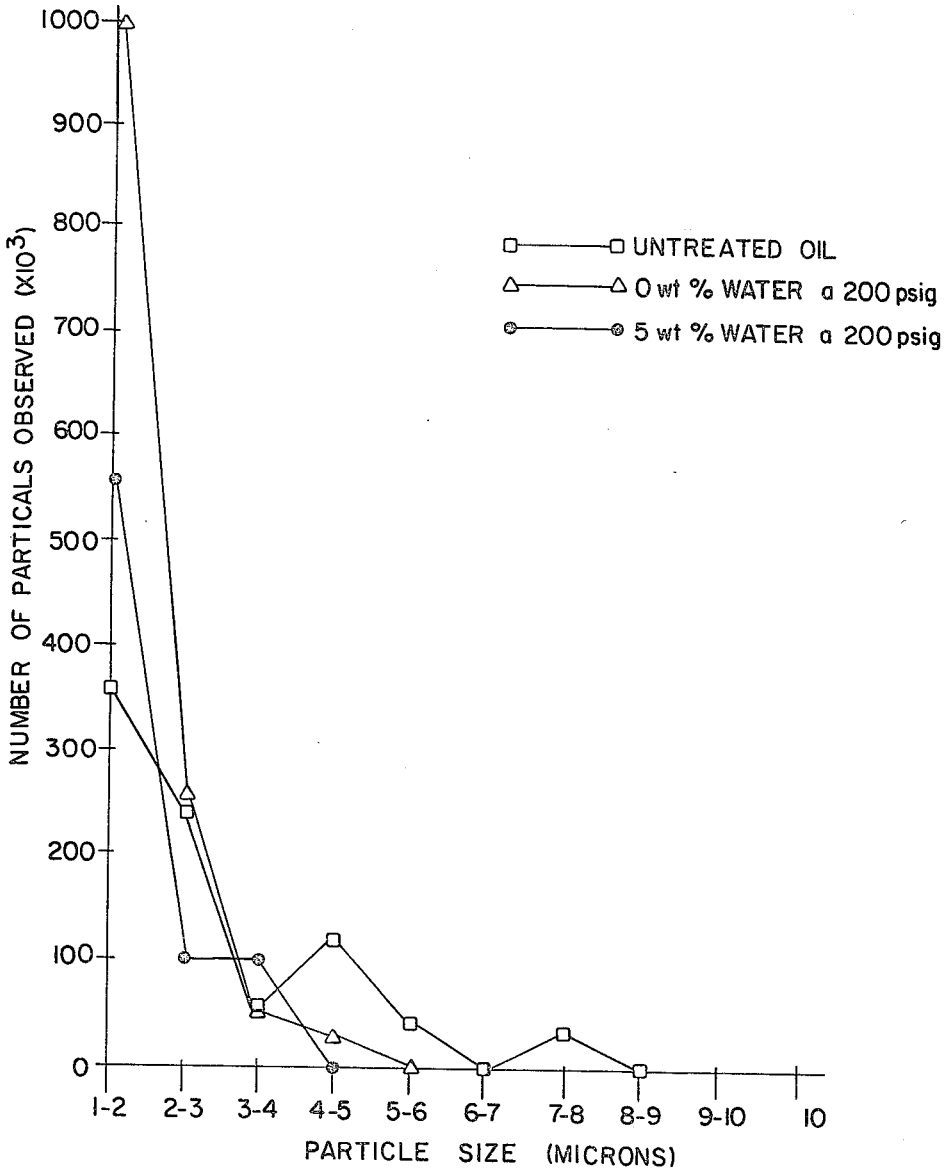
FIG. 3 is a graph showing the number of particles observed in various size ranges before and after treatment of a high asphaltene fuel oil (e.g. No. 6 fuel oil having 8.39 weight% asphaltene) using the most desirable processing variables.

FIGS. 2 and 3 illustrate the marked decrease in the occurence of larger asphaltene particles following treatment with the invented process. As the oils are processed at the optimal conditions (100 psig with 5 weight% water or 200 psig with 10 weight% water for the lower asphaltene oils and 200 psig with 5 weight% water or 200 psig with 0 weight% water for the high asphaltene oil) the vast majority of observable particles are those having diameters of 1–2 microns.

It is to be understood that the following claims are intended to cover all of the generic and specific features of the invention herein described and all statements of the scope of the invention which might be said to fall therebetween.

What is claimed is:

1. A process for the treatment of asphaltene-bearing heavy fuel oils to reduce acid-smut in stackgas resulting from burning said fuels comprising the steps of processing said heavy fuel oil under pressure, through a restricted liquid shearing apparatus with the addition of controlled amounts of water, and simultaneously reducing asphaltene particle size such that a majority of resulting asphaltene particles are below 2 microns in diameter with substantially all said asphaltene particles less than 7 microns in diameter and dispersing said particles uniformly throughout said fuel oil.

2. A process as defined in claim 1 wherein said water is used in concentrations up to 10 weight percent.

3. A process as defined in claim 1 wherein said shearing apparatus comprises a plurality of orifices having a maximum diameter of 9/32 inch.

4. A process for the treatment of low-to-medium asphaltene bearing fuel oil comprising the step of adding a controlled amount of water to said fuel oil and passing the resultant oil-water mixture, under pressure, through restricted diameter orifices, to produce an oil product having a majority of any detectable asphaltene particles as small as 1–2 microns in diameter with substantially all said asphaltene reduced to particles less than 7 microns in diameter.

5. A process as defined in claim 4 wherein the average size of said particles is below 2.5 microns.

6. A process as defined in claim 4 wherein said fuel oil is processed at a maximum operating pressure of 200 psig.

7. A process as defined in claim 4 wherein the maximum amount of water to be used is 10 weight percent.

8. A process as defined in claim 4 wherein the ideal processing conditions are with a pressure of 200 psig with 10 weight percent water.

9. A process for the treatment of high asphaltene fuel oils comprising the steps of processing said oil, under pressure, through restricted diameter orifices, with or without the addition of water, yielding an oil product having approximately 75% of said asphalatene particles as small as 1–2 microns in diameter with few, if any, of said particles greater than 5 microns in diameter.

10. A process as defined in claim 9 wherein the reduced average particle size of said asphaltenes is less than about 2 microns in diameter.

11. A process as defined in claim 9 wherein said fuel oil is processed at a maximum operating pressure of 200 psig.

12. A process as defined in claim 9 wherein water is added to said oil in concentrations up to 10 weight percent.

13. A process as defined in claim 4 wherein said treated oil is characterized by a lower incidence of acid-bearing stack particulate matter emissions upon burning said treated oil.

14. A process as defined in claim 9 wherein incidence of stack particulate matter emission, upon burning said treated oil, is substantially reduced.

15. A process as defined in claim 4 wherein incidence of acid smut fallout, upon burning said treated oil, is substantially reduced.

16. A process as defined in claim 9 wherein incidence of acid smut fallout, upon burning said treated oil, is substantially reduced.

* * * * *